US005524547A

United States Patent [19]

Kelly et al.

[11] Patent Number: 5,524,547

[45] Date of Patent: Jun. 11, 1996

[54] SIGNAL TUBE AND DETONATOR CORD CONNECTOR

[75] Inventors: George G. Kelly, Ontario; Mario LeCompte, Quebec, both of Canada

[73] Assignee: ICI Canada Inc., Ontario, Canada

[21] Appl. No.: 253,395

[22] Filed: Jun. 3, 1994

[51] Int. Cl.[6] ..... F42B 3/00; C06C 5/04

[52] U.S. Cl. ..... 102/318; 102/322; 102/275.2; 102/275.3; 102/275.7

[58] Field of Search ..... 102/318, 322, 102/275.2, 275.3, 275.7

[56] References Cited

U.S. PATENT DOCUMENTS

| | | | |
|---|---|---|---|
| 1,887,122 | 11/1932 | Duffy | 102/275.3 |
| 1,991,857 | 2/1935 | Lewis | 102/275.3 |
| 3,205,818 | 9/1965 | Coulson | 102/275.2 |
| 3,783,789 | 1/1974 | Rose | 102/275.3 |
| 3,789,761 | 2/1974 | Travor | 102/275.3 |
| 4,424,747 | 1/1984 | Yunan | 102/275.2 |
| 4,699,059 | 10/1987 | Kelly et al. | 102/275.7 |
| 4,771,694 | 9/1988 | Bartholomew et al. | 102/275.7 |
| 4,815,382 | 3/1989 | Yunan | 102/275.7 |
| 4,821,645 | 4/1989 | Reiss | 102/275.7 |
| 5,171,935 | 12/1992 | Michna et al. | 102/275.7 |
| 5,286,053 | 2/1994 | Lenzen et al. | 102/275.2 X |
| 5,299,500 | 4/1994 | Lindquist et al. | 102/275.7 X |

*Primary Examiner*—Peter A. Nelson
*Attorney, Agent, or Firm*—Charles Q. Buckwalter

[57] ABSTRACT

The present invention is directed to an improved connector comprising a first and second holding means for pressure fitting a detonating cord and shock tube in a substantially orthogonal pressure fitting relationship.

2 Claims, 3 Drawing Sheets

SIGNAL TUBE AND DETONATOR CORD CONNECTOR

The present invention is directed to an improved signal tube and detonator cord connector used in the Explosives industry. The connector comprises a means for enhancing the communication between a detonating cord and signal tube with a holding means for holding the detonating cord and signal tube. The connector is also improved by its design which provides a connector capable of use in a wide temperature range.

The Explosives industry uses various technologies to communicate from one blast hole to another. This technology is generally referred to as initiation systems. There are two different kinds of initiation systems, one electric and the other called nonelectric. The present invention is directed to the nonelectric type of initiation system.

Nonelectric initiation systems are comprised of detonating cords and plastic tubes with explosive powders placed within the tube. The cord may be made to communicate with the tube by placing them in contact with each other, thereby enabling an already initiated cord capable of initiating a single or plurality of additional tubes. Signal tubes are generally loaded with enough powder to transmit a signal and are generally not used to detonate the explosive. A signal tube can be made to initiate from a detonating cord and then is made to communicate with a detonator thus initiating the explosion.

A problem in this art is bringing the various communication means available in intimate connection under a variety of environmental conditions. If the connection is ineffective, then the signal will not be transferred, thus creating a situation where part of the explosive design will not initiate while other parts will. This may result in an ineffective blast, thus wasting time and money, and resulting in an unsafe blast site. The environmental conditions range from the jungles of the Amazon to the tundra of the Arctic. Past connectors have exhibited inconsistent performance in this range of temperatures. The present invention is found to be effective within this range of temperature with consistent performance.

An additional problem in this art is securing the communication between different detonating cords and shock tubes within the connector. The present invention provide means for holding tubes adroitly thus enhancing the communication between the detonating cord and shock tube. The present invention is found useful for connecting nonelectric initiation systems such as shock tubes and detonating cords.

SUMMARY OF THE INVENTION

A connector to combine holding means for a single or plurality of detonating cords and signal tubes to initiate explosions wherein said connector comprises a first means for holding a signal tube in substantially an orthogonal and pressure fitting communication with a detonating cord and said connector wherein said tube is slidably inserted into a channel and first holding means of said connector and said cord is positioned and slidably inserted into a second holding means within said connector in substantially an orthogonal juxtaposition and in pressure fitting communication with said tube wherein said first and second holding means receivably accepts said cord in a temperature range of −40 to 40 degrees centigrade.

Figure 1:
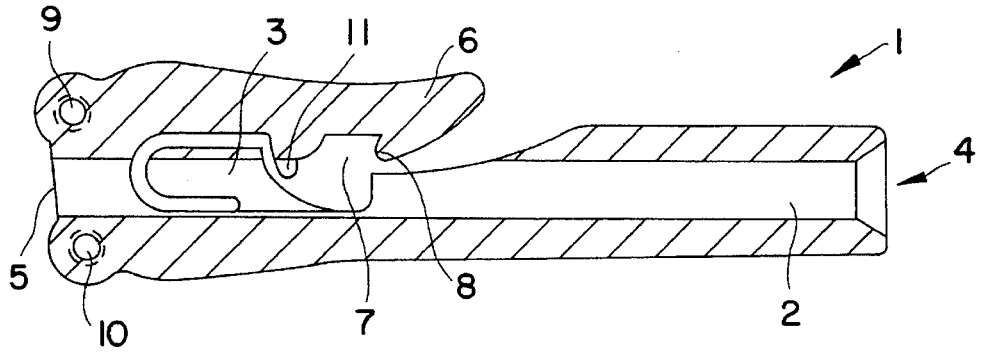
FIG. 1 is a cross-sectional drawing of the connector.

FIG. 1 is a cross-sectional view of an embodiment of the present invention. The connector, 1, comprises a channel, 2, said channel beginning a first end, 4, of said connector extending through to the second end, 5, of said connector. Inner guide means, 3, is a circular collar which receives a shock tube, not shown, from said first end, 4, wherein said shock tube is slidably moved through partially closed channel 2 to guide means 3. Guide means 3 directs the shock tube through said connector second end, 5. The shock tube is then completely channeled through the connector. A clipping means, 6, provides an entry point for the detonating cord wherein said detonating cord is substantially orthogonally juxtaposed to the shock tube and slidably seated into the detonating cord seat, 7. The lip, 8, provides a pressure fitting means whereby said detonating cord is prevented from leaving the detonating cord seat, 7. A first orifice, 9, and a second orifice, 10, provide a channel at either or both positions which facilitates by providing flexibility, the slidability of the detonating cord into the detonating cord seat. Orifices 9 and 10 also decrease the mass of the connector. Orifices 9 and 10 are important voids in low temperature applications when materials may become brittle. By providing the connector with select voids, the connector may be manipulated without breakage. An edge, 11, is provided to prevent the detonating cord from sliding out of the detonating cord seat toward end, 5.

Figure 2:
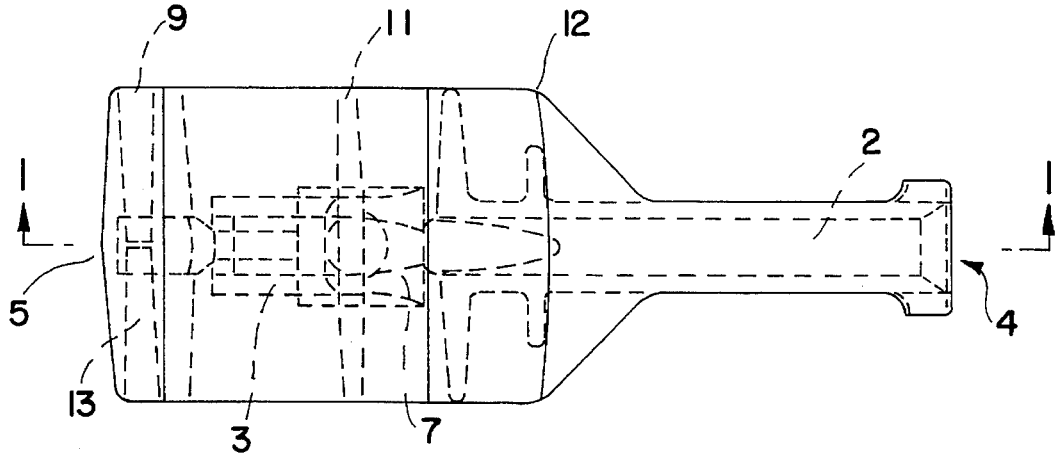
FIG. 2 is a frontal view of the connector.

FIG. 2 is a frontal view of the connector embodiment. Clip end, 12, is the end portion of the clipping means. The edge, 11, is shown in the frontal view as continuing across the length of the clipping means. Additionally, orifice 9 is shown as the beginning opening of channel 13. The guide means, 3, is shown as fingers in the frontal view and are hidden behind the clipping means 6.

Preferably, the shock tube, not shown, is inserted through first end 4, continues through channel 2, next through inner guide means 3 and out through second end 5. The detonating cord is orthogonally inserted at the detonating cord seat 7 and preferably made to seat juxtaposed to the shock tube with said detonating cord closest to clipping means 6.

Figure 3:
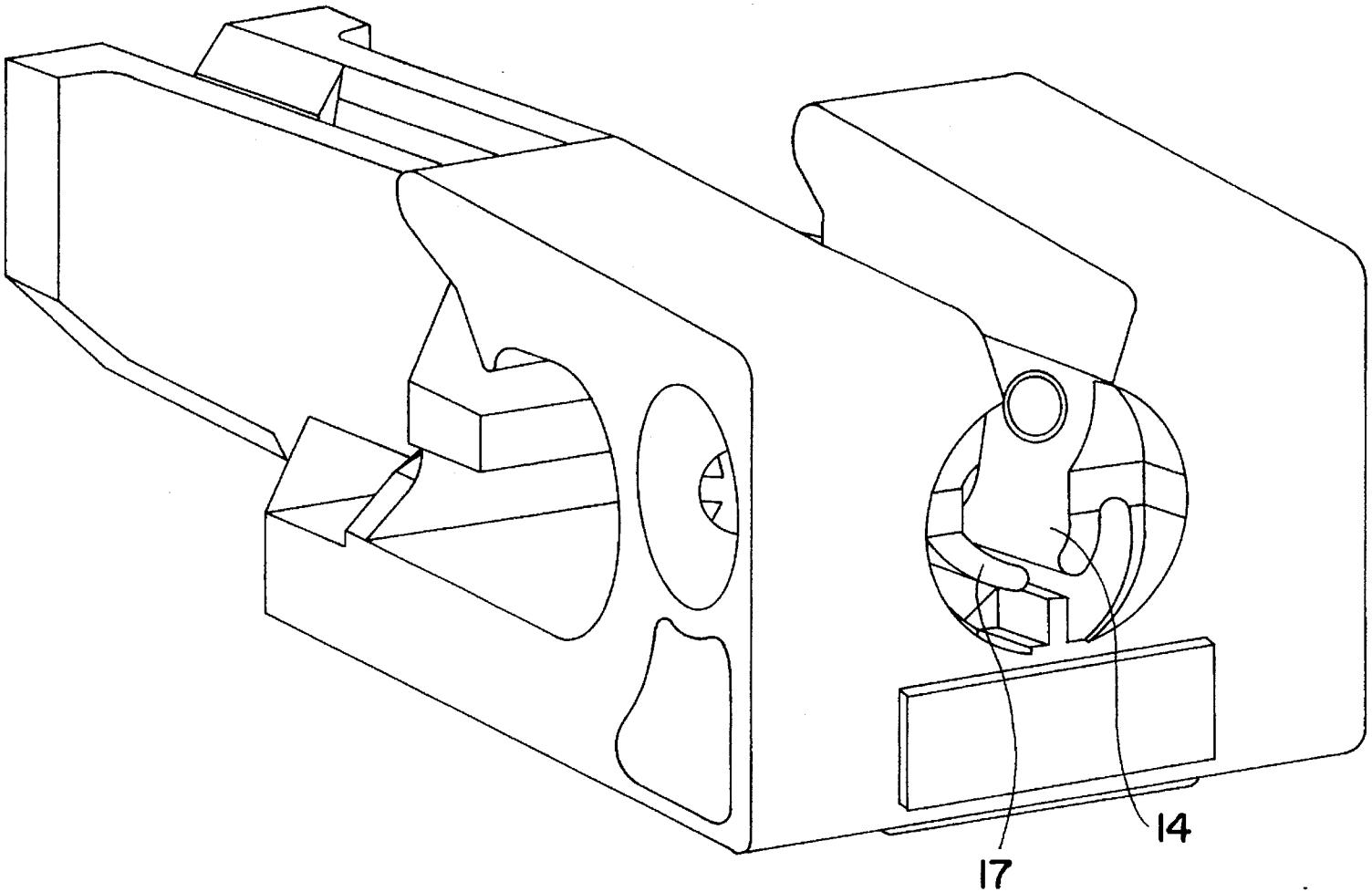
FIG. 3 is a second end view of the drawing showing the circular fingers.

FIG. 3 shows an additional embodiment of the inventive connector with added circular fingers 14. The circular ribbed fingers provide the connector with additional flexability since the fingers open wider for larger diameter shock tube maintaining the pressure fitting holding means. The circular fingers are compressive, thereby allowing a pressure fitting relationship to smaller diameter shock tubes. The ribbed elements, 17, provide additional holding means for securing the tube.

Figure 4:
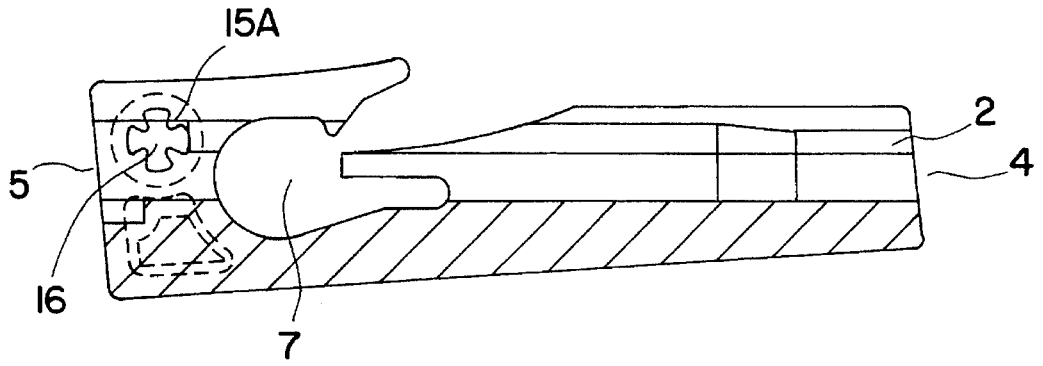
FIG. 4 is a cross-section of an additional embodiment of the connector.
Figure 5:
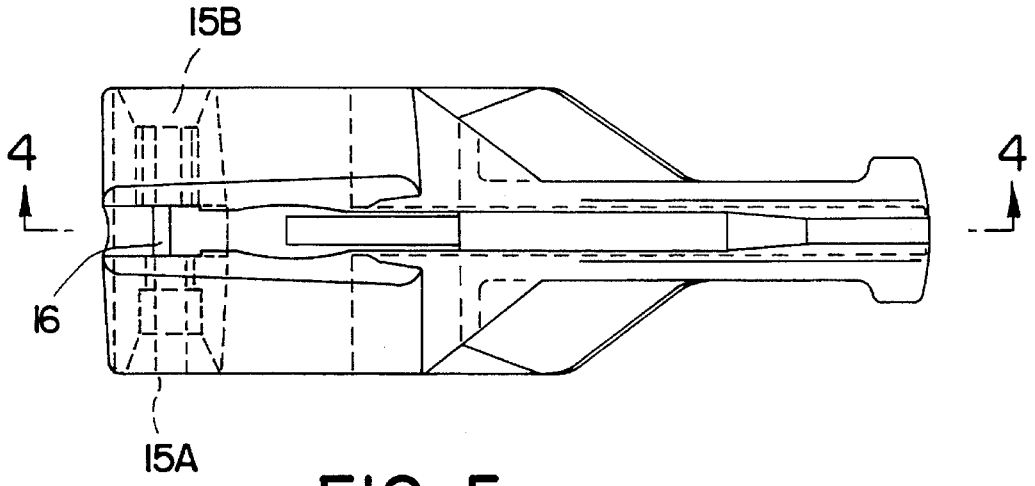
FIG. 5 is a frontal view of the additional embodiment of the connector.

FIG. 4 shows an additional embodiment to the inventive connector. In this embodiment the channel is open from first end 4 to second end 5. The splined channel, 15A, houses pin 16 wherein said pin may be slidably moved through said splined channel 15A, to partially close said channel 2, said pin in substantially an orthogonal relationship to said channel 2. At its working rest position pin 16 resides partially in circular channel 15A and partially in circular channel 15B, thereby the pin is supported on either end by channels 15A and 15B, respectively. Generally, the pin is slidably moved to partially close the channel after the shock tube has been inserted into the connector as shown in FIG. 5. The pin then creates a pressure fitting means juxtaposed to the shock tube, holding the shock tube in place. The detonating cord is slidably inserted in an orthogonal relationship to the shock tube in the detonating cord seat 7. After both shock tube and detonating cord are inserted into the connector, the tube and cord communicate. Upon initiation, energy is transferred from cord to tube maintaining the continuity of the signal transfer. Notably, the second embodiment of the first holding means provides a channel 2 which may be completely open until pin 16 is in its working position. It may be partially closed prior thereto, as well.

The connector may be made from any material capable of being formed into the connector shape. Preferably, the connector is made from polyethylene, either low, middle, or high density polyethylene. Plastic materials in general have been found to be convenient for the purposes of manufacturing many molded articles and are preferred for this improved connector.

Molding of the connector is generally accomplished by creating a master mold and injecting molten plastic in the mold, cooling and ejecting the piece from the mold. Those skilled in this art will know of various forming techniques which could be used to mold this particular connector.

We claim:

1. A connector to combine holding means for a single or plurality of detonation cords and signal tubes to initiate explosions wherein said connector comprises a channel beginning at a first end of said connector the channel extending through to a second end, within said channel is an inner guide means consisting of a circular collar which receives said signal tube after said signal tube is inserted from said first end said signal tube slidably positioned through said channel wherein said inner guide means directs said signal tube through said second end, a clipping means wherein said detonation cord is slidably seated substantially orthogonally juxtaposed to said signal tube said clipping means provided with a lip to secure said detonating cord, a first orifice linearly aligned with a second orifice positioned near said second end wherein a pin may be slidably positioned through said first and said second orifice within a splined channel thereby supported on either side of said splined channel within said first and second orifice wherein said pin creates a pressure fitting means juxtaposed to said signal tube whereby said signal tube and detonating cord communicate and each said signal tube and said detonating cord are held in said connector by a separate holding means.

2. The connector in claim 1 wherein said channel comprising ribbed flexible fingers to provide a pressure fitting holding means for said signal tube.

* * * * *